US007419323B1

(12) United States Patent
Zhang

(10) Patent No.: US 7,419,323 B1
(45) Date of Patent: Sep. 2, 2008

(54) COSMETIC DEVICE

(75) Inventor: Jun Zhang, Taipei County (TW)

(73) Assignee: Chuen Chern Co., Ltd., Taipei County (TW)

( * ) Notice: Subject to any disclaimer, the term of this patent is extended or adjusted under 35 U.S.C. 154(b) by 0 days.

(21) Appl. No.: 11/833,556

(22) Filed: Aug. 3, 2007

(51) Int. Cl.
*A46B 17/04* (2006.01)
*A46B 11/04* (2006.01)
*B43M 11/06* (2006.01)

(52) U.S. Cl. ..... 401/269; 401/280; 401/202; 401/183; 401/186

(58) Field of Classification Search ..... 401/183, 401/186, 202, 269, 270, 280, 290, 213, 262
See application file for complete search history.

(56) References Cited

U.S. PATENT DOCUMENTS 6,854,914 B2 * 2/2005 Keating et al. ..... 401/270
6,935,802 B1 * 8/2005 Byun ..... 401/278
7,229,229 B2 * 6/2007 Wang ..... 401/280

* cited by examiner

*Primary Examiner*—David J Walczak
(74) *Attorney, Agent, or Firm*—Rosenberg, Klein & Lee

(57) ABSTRACT

A cosmetic device includes a barrel for receiving liquid cosmetic material and an insertion tube is inserted in the barrel. The insertion tube includes a through hole which communicates with the interior of the barrel, and an activation tube is movably inserted into the insertion tube to open or seal the through hole when the insertion tube is moved. A mounting member is mounted to the barrel and the activation tube extends through the mounting member. A cosmetic piece is connected to the activation tube. The activation tube includes two wings which are connected to two plates which are movably located on outside of the mounting member. A cap is mounted to the mounting member and has ribs which are able to move the plates to pull the activation tube to open the through hole through which the liquid cosmetic material flows to the cosmetic piece via the activation tube.

8 Claims, 7 Drawing Sheets

COSMETIC DEVICE

FIELD OF THE INVENTION

The present invention relates to a cosmetic device with a cap which activates an activation tube when the cap is removed from the barrel and seals the activation tube when the cap is pushed back.

BACKGROUND OF THE INVENTION

A conventional cosmetic device generally includes a barrel with a space defined therein and liquid cosmetic material is received in the space. A cosmetic piece is connected to an end of the barrel such that when the user squeezes the barrel, the liquid cosmetic material flows to the cosmetic piece to be used. In order to avoid contamination to the cosmetic piece, a cap is threadedly mounted to the barrel and includes an elongate space in which the cosmetic piece is received. The cap has to be long enough to accommodate the cosmetic piece and therefore requires a certain space when the cosmetic device is received in the user's bag or pocket.

The present invention intends to provide a cosmetic device that includes an activation tube which is operated by operation of the cap so that when the cap is removed, the activation tube is pulled to a position where the liquid cosmetic material flows to the cosmetic piece connected to the activation tube, and when the cap is re-capped, the activation tube is pushed to a sealed position where the cosmetic material is sealed in the barrel.

SUMMARY OF THE INVENTION

The present invention relates to a cosmetic device that comprises a barrel which has an interior for receiving liquid cosmetic material, and an insertion tube is inserted into a connection portion extending from an end of the barrel. The insertion tube has a through hole defined through a wall thereof and the through hole communicates with the interior of the barrel. A positioning member is connected to the connection portion and the insertion tube is received in the central hole of the positioning member. An activation tube has a longitudinal passage and extends through the positioning member. A first end of the activation tube is movably inserted into the insertion tube and a second end of the activation tube extends through the positioning member. The first end of the activation tube removably seals the through hole of the insertion tube. A mounting member is mounted to the positioning member and an inward tubular recess is defined axially in a distal end of the mounting member. The second end of the activation tube is inserted into the inward tubular recess and a cosmetic piece is inserted in the inward tubular recess and mounted to the second end of the activation tube. Two apertures are defined through the mounting member and two wings extend radially outward from the activation tube movably extend through the two apertures. Two plates are located on an outside of the mounting member and connected with the two wings. A cap is mounted to the mounting member and has two ribs extending inward from an inner periphery thereof. The ribs drive the two plates to move the activation tube away from the barrel to open the through hole of the insertion tube.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
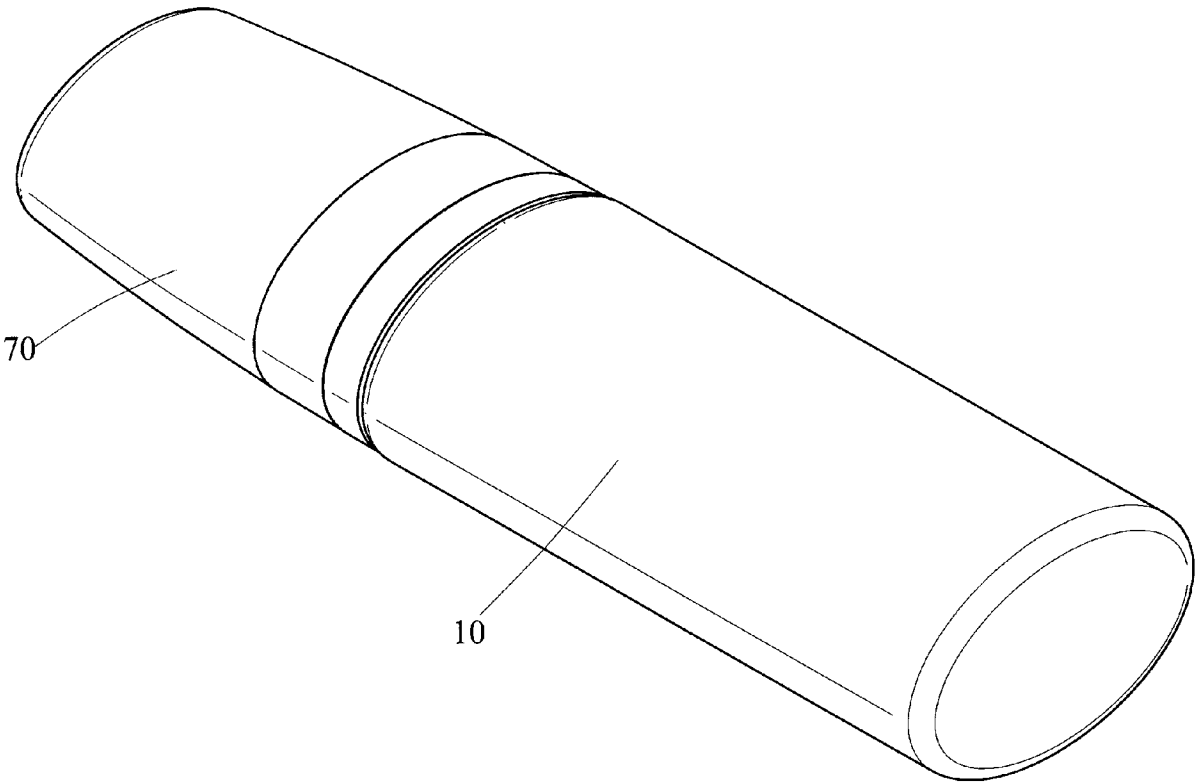
FIG. 1 is a perspective view to show the cosmetic device of the present invention.
Figure 2:
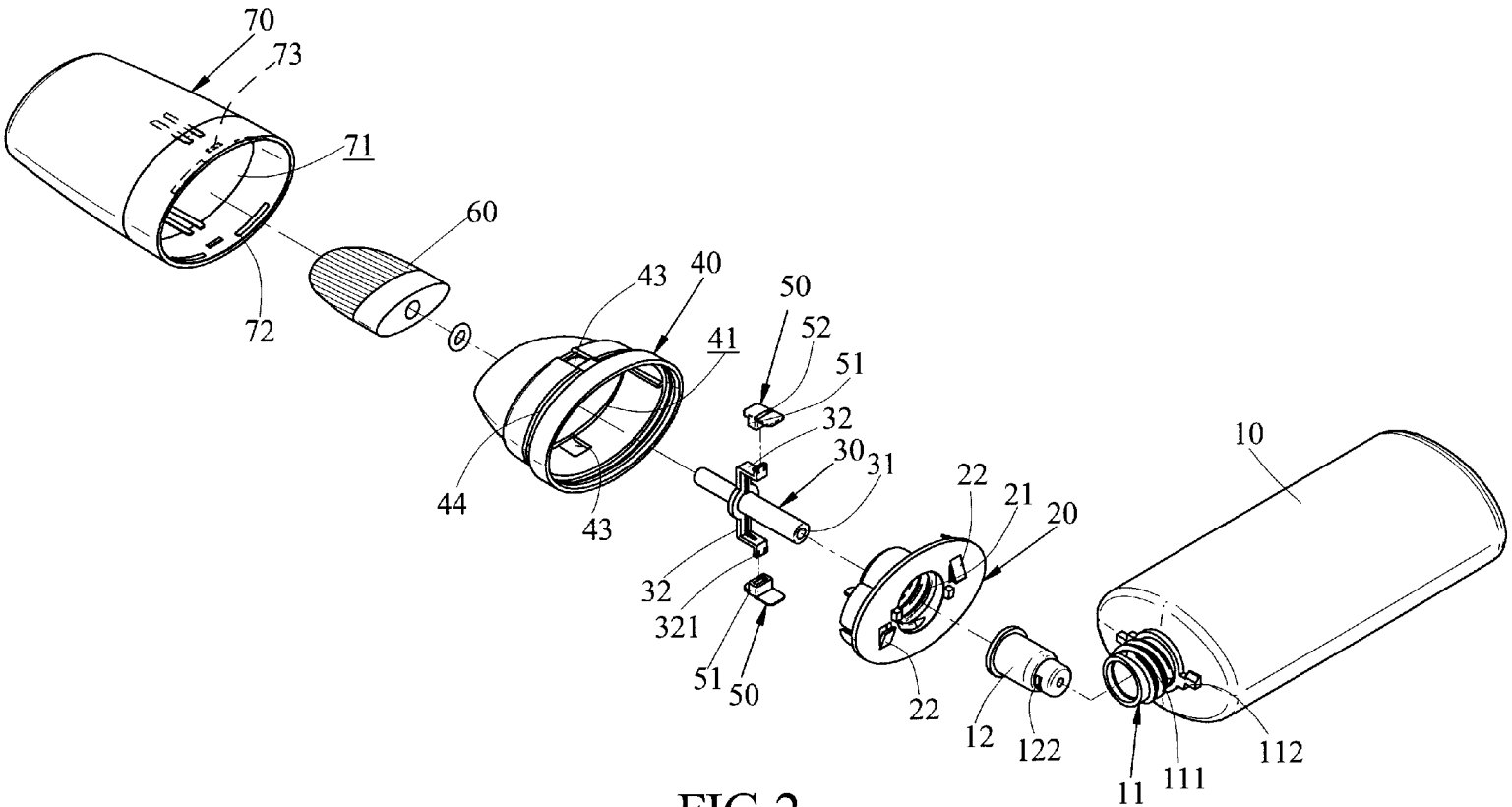
FIG. 2 is an exploded view to show the cosmetic device of the present invention.
Figure 3:
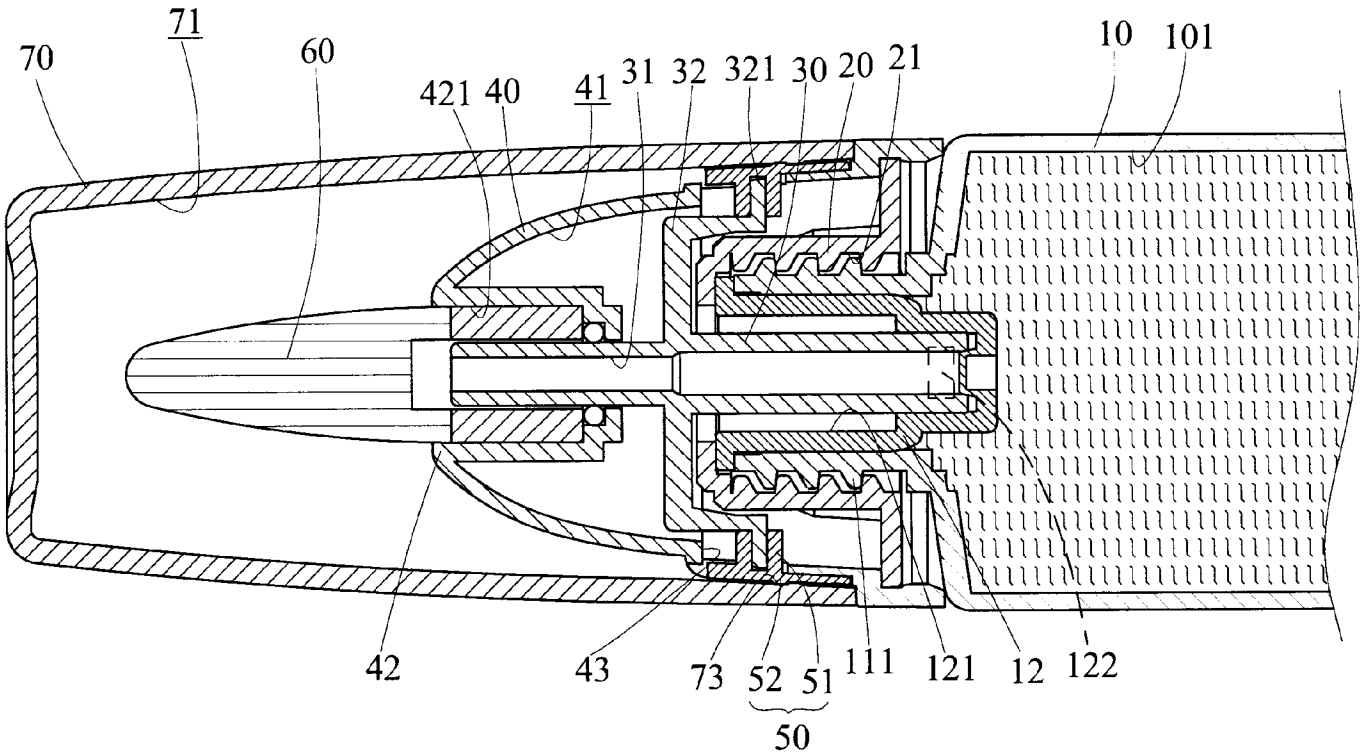
FIG. 3 is a cross sectional view to show the cosmetic device of the present invention wherein the cap has not yet removed.

Referring to FIGS. 1 to 3, the cosmetic device of the present invention comprises a soft barrel 10 having a connection portion 11 extending from an end thereof and the connection portion 11 has a passage which communicates with an interior 101 of the barrel 10. Liquid cosmetic material is received in the interior 101 of the barrel 10. The connection portion 11 of the barrel 10 includes threaded outer periphery 111 and two first locking members 112 are located on the end of the barrel 10 with the connection portion 11 located between the two first locking members 112.

An insertion tube 12 is inserted into the passage of the connection portion 11 and a through hole 122 is defined through a wall of the insertion tube 12. The insertion tube 12 communicates with the interior 101 of the barrel 10. The insertion tube 12 has two open ends so that the liquid cosmetic material may enter the insertion tube 12 via the open end and the through hole 122.

A positioning member 20 is connected to the connection portion 11 and has a central hole 21. The central hole 21 of the positioning member 20 includes threaded inner periphery which is engaged with the threaded outer periphery 111 of the connection portion 11. The insertion tube 12 is received in the central hole 21 and pressed to the connection portion 11. The positioning member 20 includes two second locking members 22 on an underside thereof, and the first and second locking members 112, 22 are locked to each other to provide extra secure connection between the positioning member 20 and the barrel 10.

An activation tube 30 has a longitudinal passage 31 and extends through the central hole 21 of the positioning member 20. A first end of the activation tube 30 is movably inserted into the insertion tube 12 and a second end of the activation tube 30 extends out from the positioning member 20. The first end of the activation tube 30 removably seals the through hole 122 of the insertion tube 12 when the activation tube 30 is not yet pulled in a direction away from the barrel 10. A collar is mounted to the activation tube 30 and includes two wings 32 extending radially outward from the collar, each of the wings 32 includes a connection end 321.

Figure 4:
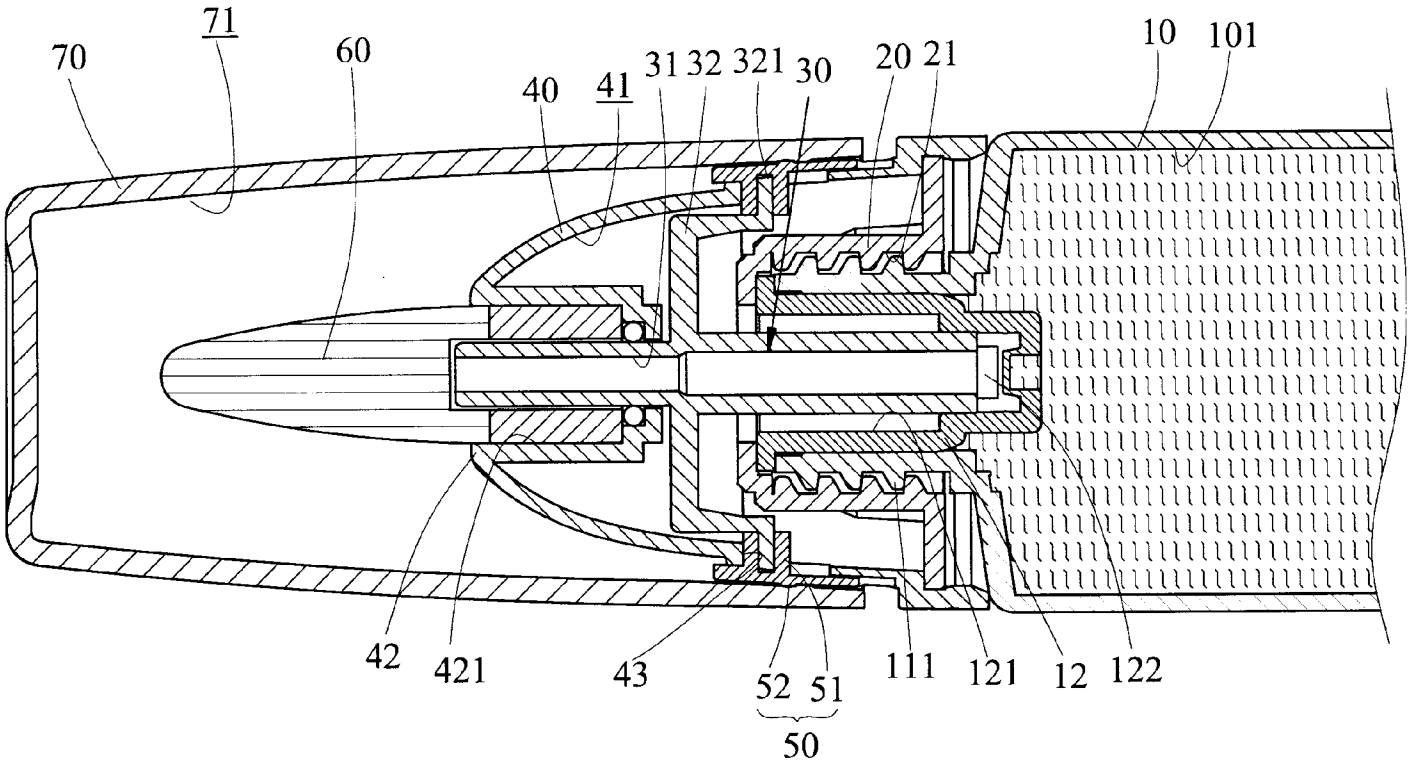
FIG. 4 is a cross sectional view to show the cosmetic device of the present invention wherein the cap is removed.
Figure 5:
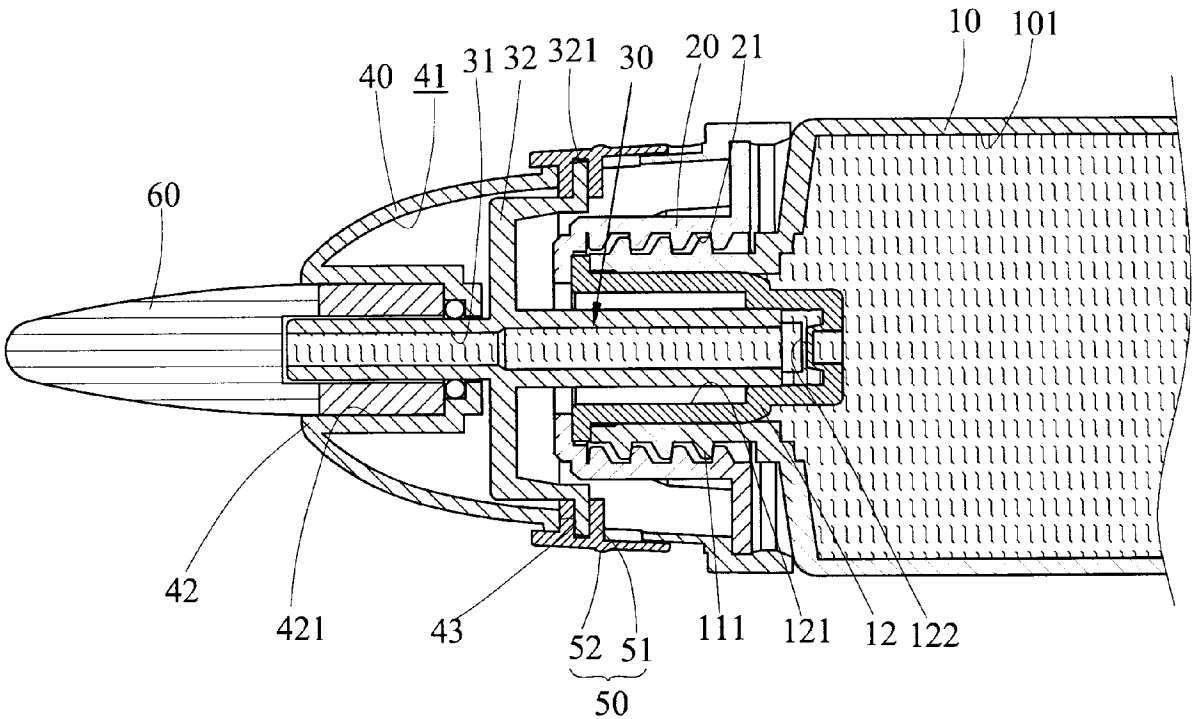
FIG. 5 shows that the barrel is squeezed and the liquid cosmetic material flows to the cosmetic piece.

A mounting member 40 is mounted to the positioning member 20 and has an accommodation space 41 in which the positioning member 20 and the activation tube 30 are accommodated. An inward tubular recess 421 is defined axially in a distal end 42 of the mounting member 40 and the second end of the activation tube 30 is inserted into the inward tubular recess 421. A cosmetic piece 60 such as a lip brush is inserted in the inward tubular recess 421 and mounted to the second end of the activation tube 30. Two apertures 43 are defined through the mounting member 40 and the two wings 32 on the activation tube 30 movably extend through the two apertures 43. Two plates 50 are located on an outside of the mounting member 40 and each plate 50 has a clamping portion 51 which is securely connected to the connection end 321. Each plate 50 further has a flange 52 extending from an outside thereof. A groove 44 is defined in an outer periphery of the mounting member 40 and communicates with the two apertures 43, A cap 70 is mounted to the mounting member 40 and has a receiving space 71 for receiving the mounting member 40 and the cosmetic piece 60. Two ribs 73 extend inward from an inner periphery of the cap 70 and are able to drive the two plates 50 to move the activation tube 30 in a direction away from the barrel 10 so as to open the through hole 122 of the insertion tube 12 when removing the cap 70 as shown in FIG. 4. The first end of the activation tube 30 moves a distance so that the through hole 122 is opened such that the liquid cosmetic material can flow to the cosmetic piece 60 by squeezing the barrel 10 as shown in FIG. 5. When re-capping the cap 70, the ribs 73 pushes the flanges 52 to move the plates 50 so that the activation tube 30 is moved with the plates 50 to seal the through hole 122 again. The ribs 73 are then moved over the flanges 52 and located at the position as shown in FIG. 3. The cap 70 further includes ridges 72 extending from the inner periphery thereof so as to be removably engaged with the groove 44.

Figure 6:
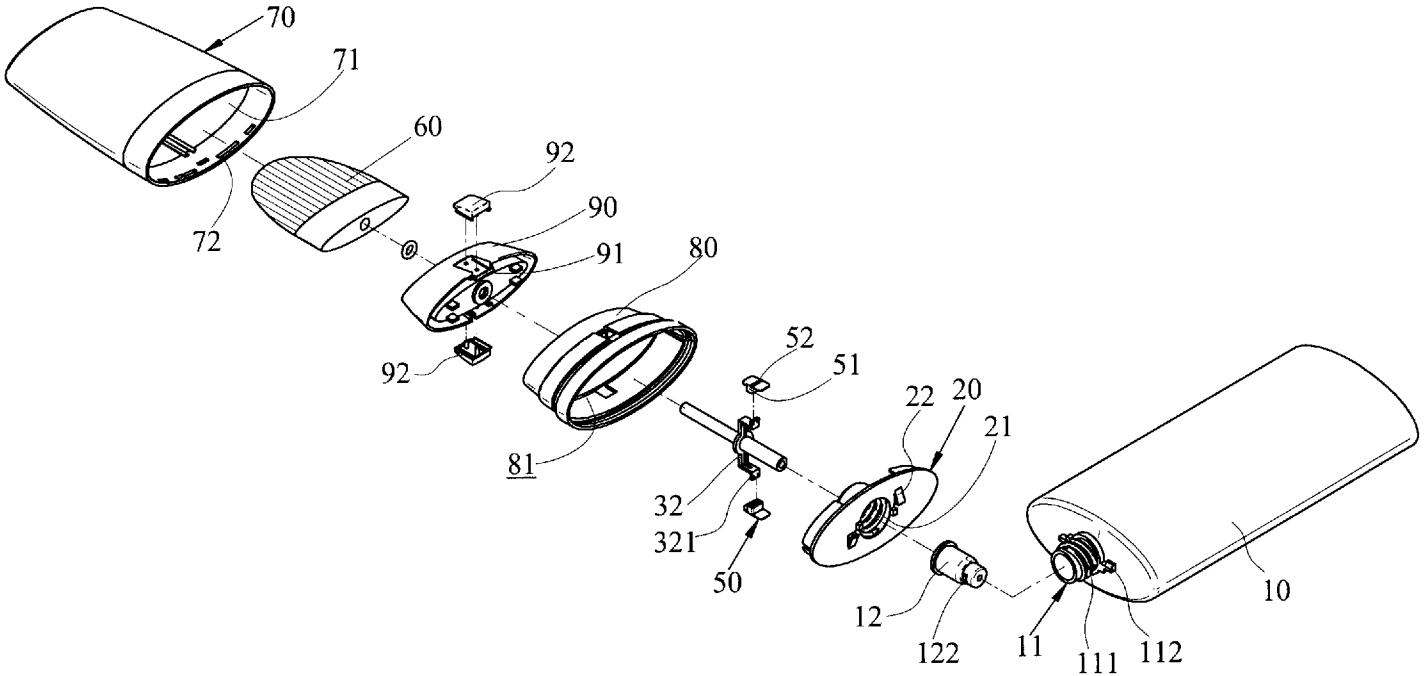
FIG. 6 is an exploded view to show another embodiment of the cosmetic device of the present invention.
Figure 7:
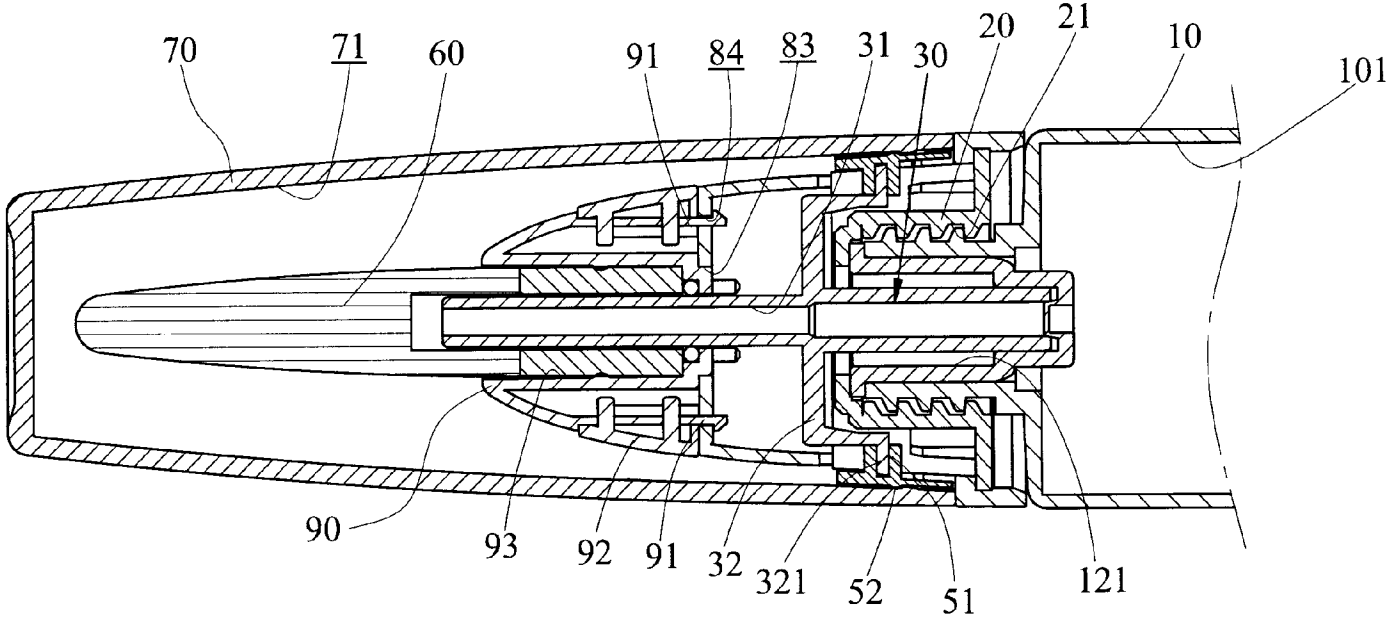
FIG. 7 is a cross sectional view to show the cosmetic device in FIG. 6.

FIGS. 6 and 7 show another embodiment of the cosmetic device of the present invention wherein the only difference form the first embodiment is that the mounting member in the second embodiment is composed of a first part 80 and a second part 90 which is connected to the first part 80. The first part 80 includes an end surface at one end and an open end 81 on the other end thereof, and the two apertures are defined in the first part 80. An engaging hole 83 and two slots 84 are defined through the end surface. The second part 90 includes the inward tubular recess 93 and an inside of the inward tubular recess 93 is engaged with the engaging hole 83. The second part 90 includes two hook plates 91 which are engaged with the slots 84 and each hook plate 91 includes two holes. Two positioning plates 92 are connected to the second part 90 and each positioning plate 92 includes two insertions which are inserted into the two holes of each hook plate 91.

While we have shown and described the embodiment in accordance with the present invention, it should be clear to those skilled in the art that further embodiments may be made without departing from the scope of the present invention.

What is claimed is:

1. A cosmetic device comprising:

a barrel having a connection portion extending from an end thereof and the connection portion having a passage which communicates with an interior of the barrel;

an insertion tube inserted into the passage of the connection portion and a through hole defined through a wall of the insertion tube, the insertion tube communicating with the interior of the barrel;

a positioning member connected to the connection portion and having a central hole, the insertion tube received in the central hole and being pressed to the connection portion;

an activation tube having a longitudinal passage and extending through the positioning member, a first end of the activation tube movably inserted into the insertion tube and a second end of the activation tube extending through the positioning member, the first end of the activation tube removably sealing the through hole of the insertion tube, two wings extending radially outward from the activation tube;

a mounting member mounted to the positioning member and having an accommodation space in which the positioning member and the activation tube are accommodated, an inward tubular recess defined axially in a distal end of the mounting member and the second end of the activation tube inserted into the inward tubular recess, a cosmetic piece inserted in the inward tubular recess and mounted to the second end of the activation tube, two apertures defined through the mounting member and the two wings on the activation tube movably extending through the two apertures;

two plates located on an outside of the mounting member and connected with the two wings, and a cap mounted to the mounting member and having a receiving space for receiving the mounting member and the cosmetic piece, two ribs extending inward from an inner periphery of the cap and driving the two plates to move the activation tube away from the barrel so as to open the through hole of the insertion tube.

2. The device as claimed in claim 1, wherein the connection portion of the barrel includes threaded outer periphery and the central hole of the positioning member includes threaded inner periphery which is engaged with the threaded outer periphery of the connection portion.

3. The device as claimed in claim 1, wherein two first locking members are located on the end of the barrel and the positioning member includes two second locking members on an underside thereof, the first and second locking members are locked to each other.

4. The device as claimed in claim 1, each wing includes a connection end and each plate has a clamping portion which is securely connected to the connection end.

5. The device as claimed in claim 1, wherein each plate has a flange extending from an outside thereof and each rib is sized to be able to pull the flange to move the plate away from the barrel when removing the cap out from the positioning member.

6. The device as claimed in claim 1, wherein the mounting member includes a groove defined in an outer periphery thereof and the groove communicates with the two apertures, the cap includes ridges extending from the inner periphery thereof, the ridges are removably engaged with the groove.

7. The device as claimed in claim 1, wherein the mounting member is composed of a first part and a second part which is connected to the first part, the first part includes an end surface and the two apertures, an engaging hole and two slots are defined through the end surface, the second part includes the inward tubular recess and an inside of the inward tubular recess is engaged with the engaging hole, the second part includes two hook plates which are engaged with the slots and each hook plate includes two holes, two positioning plates are connected to the second part and each positioning plate includes two insertions which are inserted into the two holes of each hook plate.

8. The device as claimed in claim 1, wherein the cosmetic piece is a lip brush.

* * * * *